US007340803B2

(12) United States Patent
Howell

(10) Patent No.: US 7,340,803 B2
(45) Date of Patent: Mar. 11, 2008

(54) RAPID ATTACHMENT BUCKLE

(75) Inventor: Frank A. Howell, Oxford, ME (US)

(73) Assignee: Illinois Tool Works Inc., Glenview, IL (US)

( * ) Notice: Subject to any disclaimer, the term of this patent is extended or adjusted under 35 U.S.C. 154(b) by 295 days.

(21) Appl. No.: 10/822,549

(22) Filed: Apr. 12, 2004

(65) Prior Publication Data

US 2004/0255434 A1 Dec. 23, 2004

Related U.S. Application Data

(63) Continuation-in-part of application No. 10/413,124, filed on Apr. 14, 2003, now abandoned.

(51) Int. Cl.
*A44B 11/04* (2006.01)

(52) U.S. Cl. ..... 24/198; 24/169; 24/200

(58) Field of Classification Search ..... 24/19, 24/265 BC, 16 PB, 17 AP, 20 R–23 EE, 24/20 CW, 163 R, 168, 169, 176, 197–200, 24/128, 129 R, 130, 17 A
See application file for complete search history.

(56) References Cited

U.S. PATENT DOCUMENTS

| | | | | | |
|---|---|---|---|---|---|
| 521,806 | A * | 6/1894 | Mullikin | 16/207 |
| 541,729 | A * | 6/1895 | Dillin | 24/128 |
| 579,297 | A | 3/1897 | Ettinger | 54/34 |
| 699,502 | A | 5/1902 | Durland | 24/171 |
| 1,466,495 | A * | 8/1923 | Watson | 24/129 R |
| 1,483,853 | A | 2/1924 | Schwerd | 24/163 R |
| 1,518,767 | A | 12/1924 | Anderson | 24/20 EE |
| 1,761,520 | A | 6/1930 | Dolke | 24/194 |
| 2,840,876 | A | 7/1958 | Bliss | 24/171 |
| 3,224,056 | A | 12/1965 | Joffe | 24/16 R |
| 4,750,241 | A | 6/1988 | Powell | 24/16 R |
| 4,934,030 | A | 6/1990 | Spinosa et al. | 24/194 |
| 4,991,265 | A * | 2/1991 | Campbell et al. | 24/16 PB |
| 5,007,138 | A * | 4/1991 | Pritchard et al. | 24/23 B |
| 5,205,021 | A | 4/1993 | Durand | 24/163 R |
| 5,309,610 | A | 5/1994 | le Gal | 24/625 |
| 5,383,259 | A * | 1/1995 | McIntire | 24/300 |
| 5,542,462 | A * | 8/1996 | Elsenheimer et al. | 24/115 F |
| 5,608,918 | A | 3/1997 | Salvaggio | 2/421 |
| 5,970,585 | A * | 10/1999 | Scholey | 24/482 |
| 6,192,559 | B1 * | 2/2001 | Munsell, Jr. | 24/712.1 |

* cited by examiner

*Primary Examiner*—James R. Brittain
*Assistant Examiner*—Ruth C Rodriguez
(74) *Attorney, Agent, or Firm*—Gauthier & Connors LLP

(57) ABSTRACT

A buckle for capturing and releasably retaining an end tab of a flexible strap wherein the flexible strap has a substantially uniform width and thickness and an end tab of increased thickness. The buckle includes a base, and parallel side walls, which extend upwardly from and cooperate with the base to define an open-ended receiving channel having an entry end and an exit end. Flanges are spaced vertically from the base and extend inwardly in cantilever fashion from the side walls to define an opening-ended slot communicating with and extending along the length of the receiving channel. The slot is configured and dimensioned to accommodate longitudinal pinching and lateral insertion of the strap into the receiving channel. The flanges have undersides configured to accommodate receipt of the end tab in the receiving channel via the entry end, and to releasably retain and prevent withdrawal of the end tab from the receiving channel via the exit end.

7 Claims, 5 Drawing Sheets

RAPID ATTACHMENT BUCKLE

CROSS REFERENCE TO RELATED APPLICATIONS

This application is a continuation-in-part of U.S. Ser. No. 10/413,124 file Apr. 14, 2003 now abandoned.

BACKGROUND DISCUSSION

1. Field of the Invention

This invention relates to buckles used in combination with flexible web straps in a myriad of applications, a typical example being the attachment of rucksacks to load bearing frames.

2. Description of the Prior Art

With reference initially to FIG. 14, rucksacks 10 and the like are typically attached to external load bearing frames 12 with a web strap and bail arrangement generally indicated at 14. A bail 16 is sewn as at 18 to the ruck 10 by means of a short length 20 of web along with a longer length 22 of web. The short web length 20 is hooked around one rib 16*a* of the bail to provide the permanent attachment of the bail to the rucksack. The longer strap length 22 is hooked around the frame 12 and then threaded back beneath the bail, around ribs 16*b* and 16*c* before finally being passed back over the bail and inserted beneath rib 16*d*. It goes without saying that the threading of web 22 over and around multiple bail ribs is tedious, complex and time consuming.

When the frame 12 is used without the rucksack attached, for example, when carrying oversized or oddly shaped loads, easily and quickly detaching the rucksack from the frame becomes a consideration. At worst, it is impossible to accomplish while wearing heavy gloves or mittens. Further complications arise when the attachment web 22 is pulled tightly across the bail by heavily loading the rucksack. Under these conditions, it often becomes necessary to pry the web 22 with a levering tool of some kind (not shown) in order to loosen it sufficiently so that it can be unthreaded from the bail.

The objective of the present invention is to provide a buckle to which a flexible web strap can be readily and securely attached without laborious and time consuming threading, and from which the strap can be quickly and easily detached.

SUMMARY OF THE INVENTION

The buckle of the present invention is designed for use with a flexible web strap having a substantially uniform width and thickness, with an end tab of increased thickness. The buckle is formed with a base and parallel side walls cooperating with the base to define an open-ended receiving channel having entry and exit ends. Flanges are spaced vertically from the base and extend inwardly in cantilever fashion from the side walls to define an open-ended slot communicating with and extending along the length of the receiving channel. The slot is configured and dimensioned to accommodate longitudinal pinching and lateral insertion of the strap into the receiving channel, and the receiving channel is configured and dimensioned to receive the thickened end tab via its entry end. The undersides of the cantilevered flanges are configured to securely wedge the thickened end tab in the receiving channel and to prevent its longitudinal withdrawal via the channel's exit end. The web strap is readily separable from the buckle by first pulling it longitudinally towards the entry end, and then simply pulling it laterally from the receiving channel through the open-ended slot.

These and other features of the buckle of the present invention will now be described in greater detail with reference to the accompanying drawings, wherein:

BRIEF DESCRIPTION OF THE DRAWINGS

FIG. 13 is a perspective view of a third embodiment of a buckle of the present invention, the buckle being formed as an integral feature of a support frame or the like.

DETAILED DESCRIPTION OF PREFERRED EMBODIMENT

Figure 1:
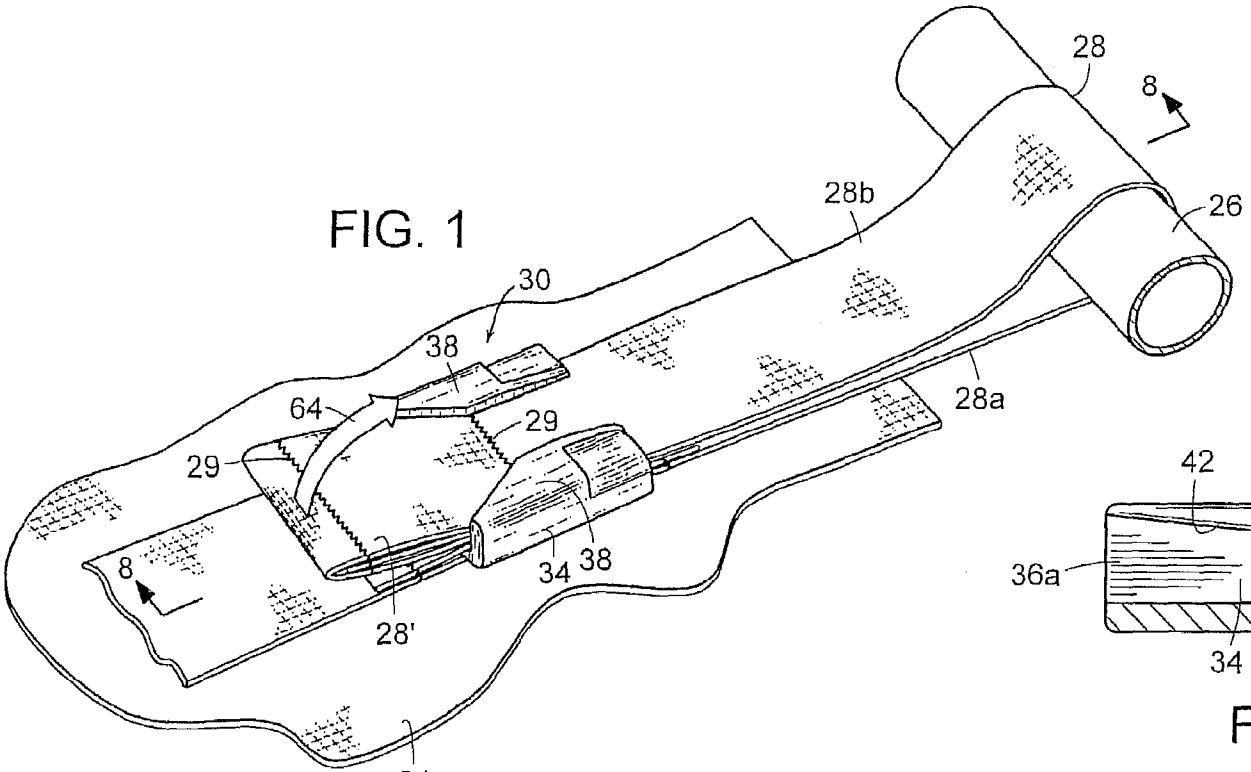
FIG. 1 is a perspective view of one embodiment of a buckle in accordance with the present invention, the buckle being shown in use attaching a rucksack or the like to a load bearing frame.
Figure 4:
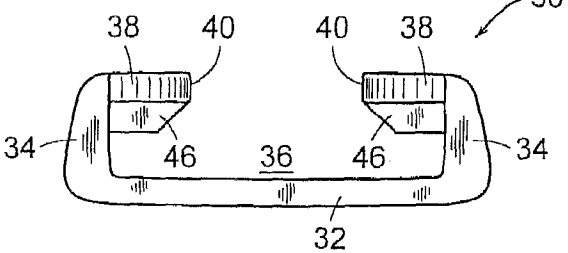
FIG. 4 is an end view of the buckle taken from the entry end.

With reference initially to FIG. 1, a portion of a rucksack 24 or the like is shown attached to a support frame 26 by means of a flexible strap 28 coacting with a buckle 30 in accordance with one embodiment of the present invention. For reasons that will hereinafter become apparent, the strap 28 is provided with a thickened end tab 28' made up of multiple folds stitched together as at 29. With reference additionally to FIGS. 2-5, it will be seen that the buckle 30 comprises a base 32 cooperating with parallel upstanding side walls 34 to define an open-ended receiving channel 36 having entry and exit ends 36*a*, 36*b*. Flanges 38 are spaced vertically from the base 32 and extend inwardly in cantilever fashion from the side walls 34 to define an open-ended slot 40 extending along the length of the channel 36.

Figure 2:
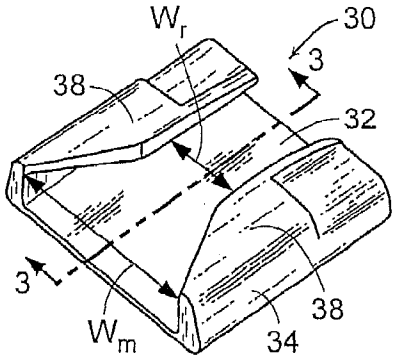
FIG. 2 is a perspective view of the buckle of FIG. 1.
Figure 3:
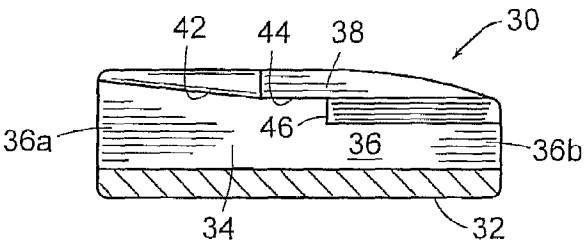
FIG. 3 is a sectional view taken along line 3-3 of FIG. 2.
Figure 5:
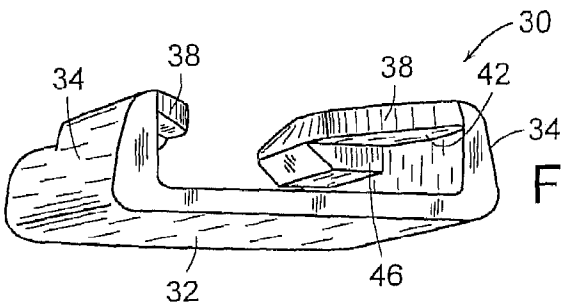
FIG. 5 is a perspective end view of the buckle also taken from the entry end.

As can best be seen in FIG. 2, the flanges 38 have converging sections leading from a maximum width $W_m$ of the slot 40 at the entry end 36*a* of channel 36 to a reduced slot width $W_r$ at an intermediate location along the channel length. The undersides of the flanges 38 are configured to provide jam surfaces 42 sloping downwardly to horizontal lands 44 which in turn lead to stepped stop surfaces 46.

Figure 8:
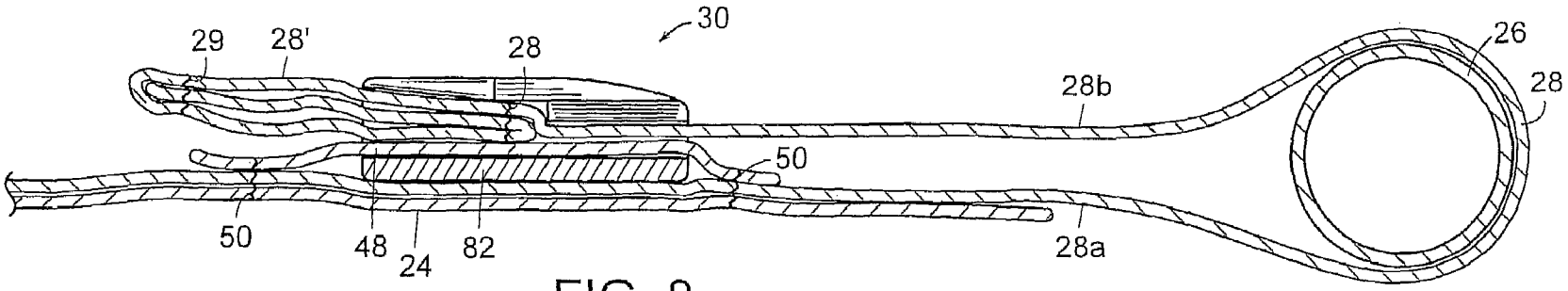
FIG. 8 is a sectional view on an enlarged scale taken along line 8-8 of FIG. 1.

As can best be seen in FIG. 8, the buckle 30 is seated on a lower run 28*a* of strap 28, and is held in place by an attachment web 48 extending over the base 32. Both the attachment web 48 and the lower strap run 28*a* are stitched as at 50 to the ruck sack 24.

Figure 6:
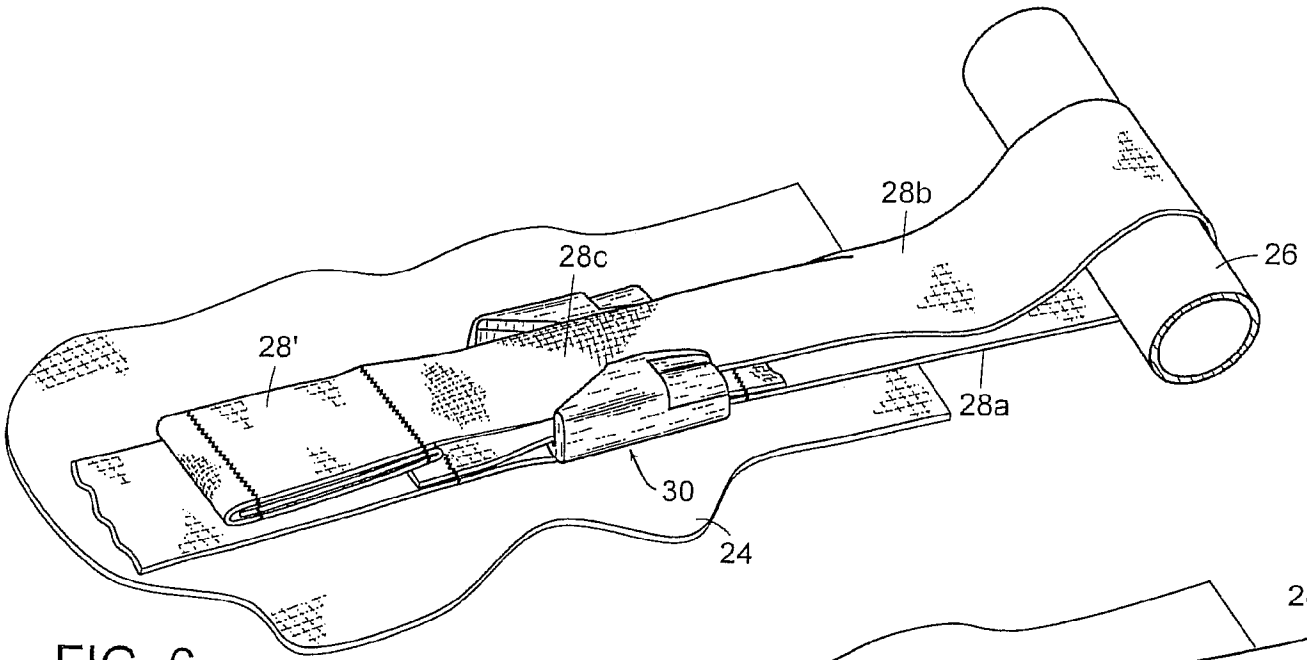
FIGS. 6 and 7 are perspective views similar to FIG. 1 showing the associated web at various stages during its interconnection with the buckle.

Referring now to FIG. 6, it will be seen that in order to attach the ruck sack 24 to the support frame 26, the strap 28 is initially wrapped around the frame, with its upper run 28*b* overlying the buckle 30, and with the thickened end tab 28' of the strap located on the entry side of the buckle's receiving channel 36. The upper strap run 28*b* may then be pinched laterally as shown at 28*c* to a reduced width slightly less than the width $W_r$ of slot 40 to accommodate its lateral insertion into the receiving channel 36. The widened section $W_m$ of slot 40 eases this task by guiding the strap to the required minimum width.

Figure 7:
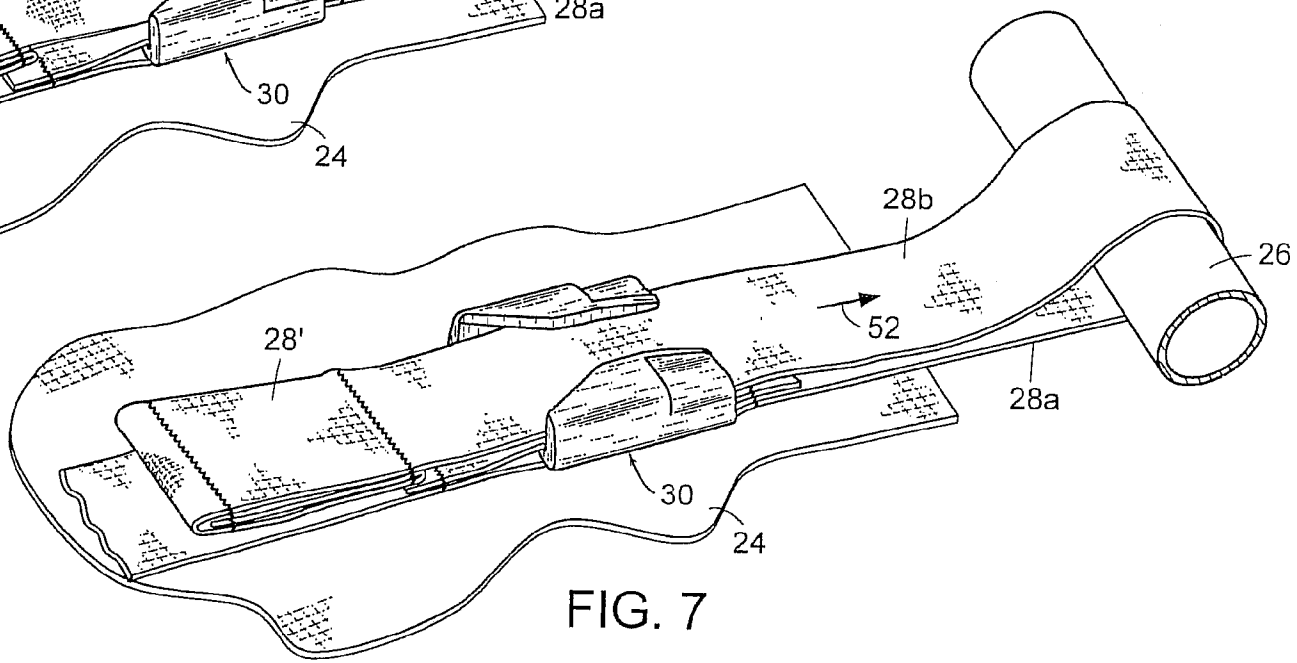

Once the upper strap run 28*b* is laterally inserted into the buckle channel 36, and as shown in FIG. 7, the upper strap run in simply pulled in the direction depicted by arrow 52, thereby pulling the thickened end tab 28' into the receiving channel 36 via its entry end 36*a*. As the thickened end tab 28' enters the channel 36, it is pinched and frictionally held between the overlying jam surfaces 42 and the underlying attachment web 48 extending over the base 32. Further entry of tab 28' into the channel 36 is blocked by its engagement with the stop surfaces 46, thus preventing the end tab from being extracted longitudinally from the channel 36 via its exit end 36*b*. With this arrangement, any loading that increases the tension in strap 28 will only serve to seat the end tab 28' more firmly in the buckle 30.

As shown in FIG. 1, the strap may be released from the buckle by first pulling the end tab 28' towards the entry end 36*a* and then simply pulling the end tab upwardly as indicated by arrow 54. The converging edges of slot 40 will serve to laterally pinch the upper strap run 28*b*, thereby facilitating its lateral removal, even when under tension.

Figure 9:
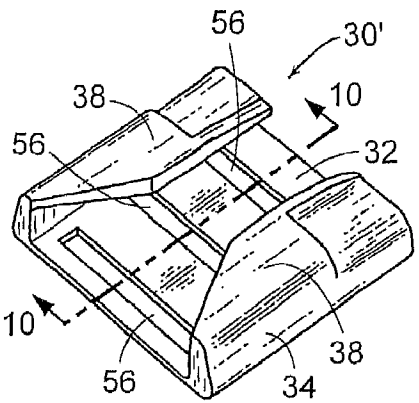
FIG. 9 is a perspective view of a second embodiment of a buckle in accordance with the present invention.
Figure 10:
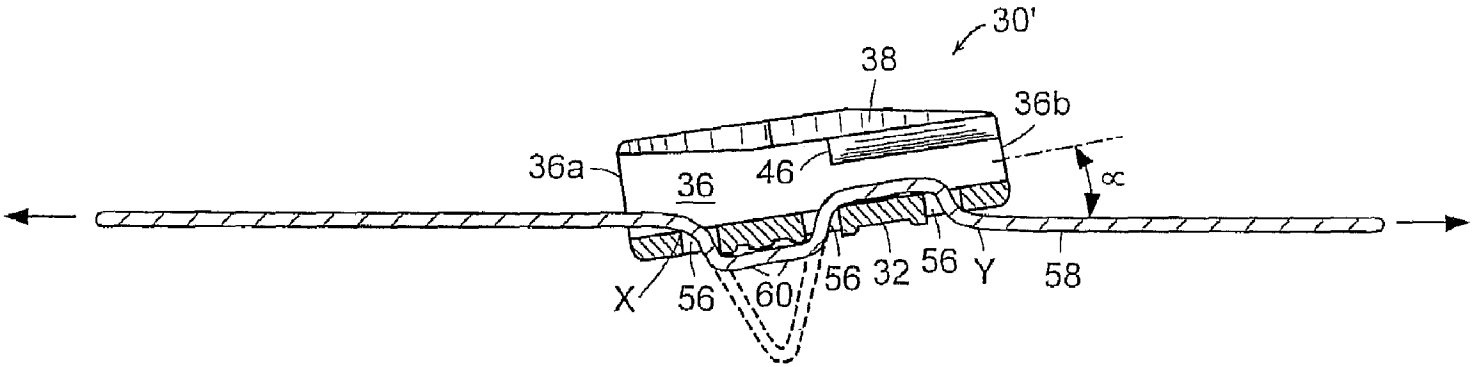
FIG. 10 is a longitudinal sectional view on an enlarged scale taken through line 10-10 of FIG. 9, and showing the buckle threaded onto a web.
Figure 12:
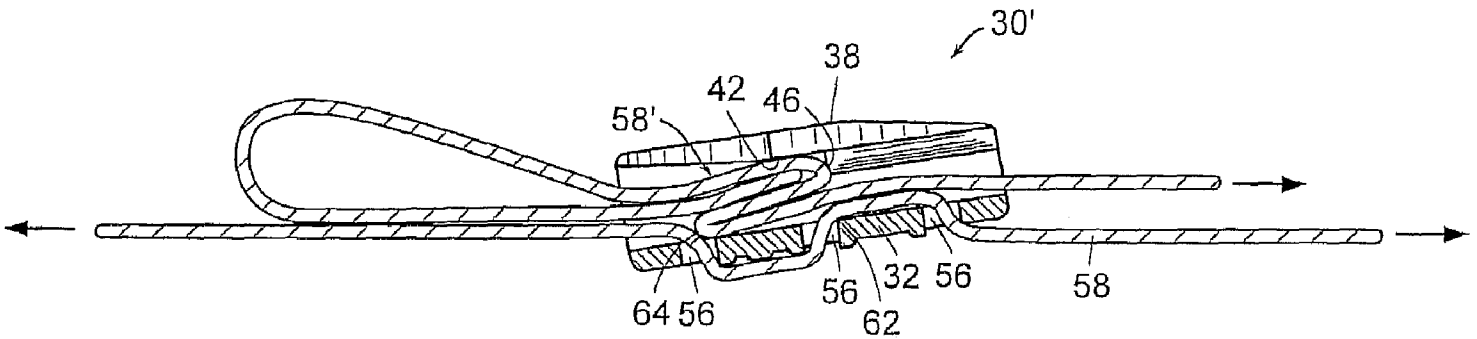
FIG. 12 is a sectional view similar to FIG. 10 and showing the end tab received and releasably locked within the buckle.
Figure 14:
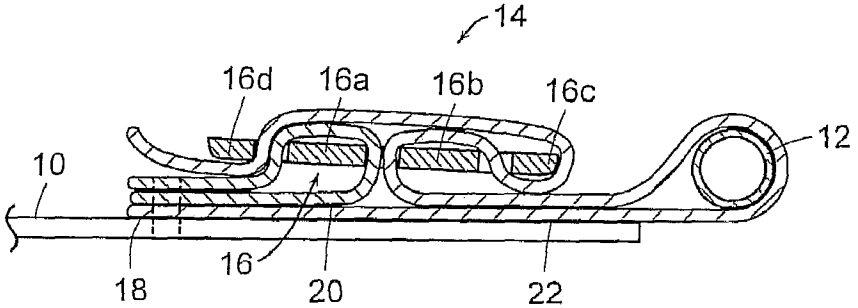
FIG. 14 PRIOR ART
FIG. 14 is a sectional view through a prior art web strap and bail arrangement.

An alternative embodiment of a buckle in accordance with the present invention is shown at 30' in FIGS. 9, 10 and 12. The same reference numerals have been employed to identify the features of buckle 30' that are common to those of buckle 30. Buckle 30' differs from buckle 30 in that its base 32 is interrupted by transverse slots 56. Buckle 30' is designed for mounting on a length of strap, an example being the strap 58 threaded through the slots 56 as shown in FIG. 10.

To keep the buckle from slipping along the web strap, friction enhancements can be added, an example being, the teeth shown at 60 in FIG. 10. As loading is increased, the web strap 58 is pulled proportionately tighter against the teeth 60, thus counteracting any tendency of the buckle to slip along the strap length. In order to adjust the location of the buckle 30' along the strap length 58, one need only remove the tension loading on the strap, after which lengths of strap can be pulled from either direction through the outer-most slots 56 to create adjustment slack (the loop shown in dotted in FIG. 10). Stripping the strap from either end then takes up the slack loop, allowing the buckle to shift along the strap length.

Again as shown in FIG. 10, the path of the web strap over point "X" at the exit end and under point "Y" at the entry end forces the buckle to rotate in a clockwise direction when the web strap 58 is under load. The extent of rotation depends on the position of the outermost slots 56 and the relative vertical positions of points X and Y. A useful angle ∞ of rotation is between 1° to 30°, and preferably between 5°-25°.

Figure 11:
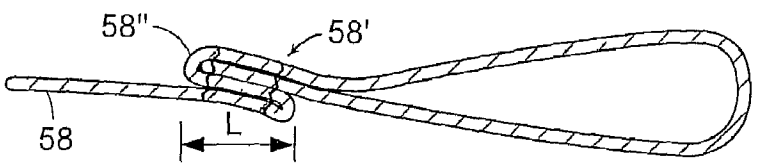
FIG. 11 is a sectional view through a thickened end tab of the web shown in FIG. 10.

FIG. 11 illustrates an end tab 58' particularly suited for use with the buckle 30'. End tab 58' has inverted folds that display a nose 58" situated above the plane of the web strap.

FIG. 12 shows the buckle 30' in interlocked engagement with the end tab 58' of web strap 58. With the buckle rotated as shown in FIG. 10, a balance is achieved between the forces exerted against the jamming and stop surfaces 42, 46 provided on the undersides of the flanges 38, and an additional jamming surface 62 formed by the web strap extending through the center slot 56. Since jamming surface 62 is located below the plane of force (the balance point of the entrance and exit strap sections), and surfaces 42, 46 are above that plane, the buckle remains stable under load with no tendency to rotate.

An important contributor to balanced loading between surfaces 42, 46 and jamming surface 62 is the inversion of the folds of end tab 58' so that the lower fold bears directly against jamming surface 62. This insures that a sufficient proportion of the load is transferred from the flanges 38 to the base 32 of the buckle where the buckle structure is more robust and less likely to distort under load.

As shown in FIG. 11, the end tab length "L" can be adjusted to seat into the pocket formed by jamming surface 62 and a retention surface 64 (see FIG. 12). This will provide resistance to forces tending to pull the end tab 58 back out through the entry end 36*a* of the buckle channel.

Figure 13:
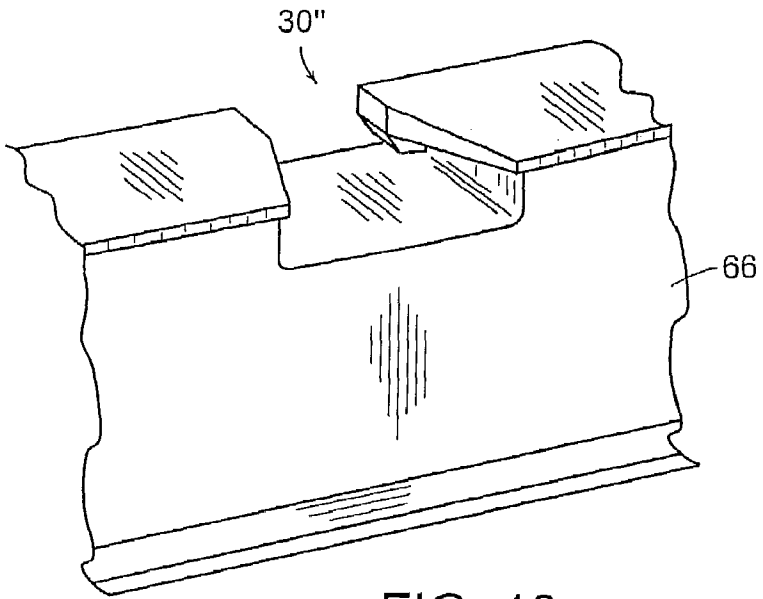

With reference to FIG. 13, a third embodiment of a buckle in accordance with the present invention as shown at 30'. The buckle 30' is formed as an integral part of a frame structure 66, with an internal configuration and resulting functions and advantages essentially identical to those discussed above with reference to buckles 30 and 30'.

I claim:

1. For use with a flexible strap having a substantially uniform width and thickness and an end tab of increased thickness, a buckle for capturing and releasably retaining said end tab, said buckle comprising:

a base;

parallel side walls extending upwardly from and cooperating with said base to define an open-ended receiving channel having an entry end and an exit end;

first slots extending transversally across said base, said buckle being aftached to said strap by weaving said strap into and out of said channel through said first slots; and flanges spaced vertically from said base and extending inwardly in cantilever fashion from said side walls to define an open-ended second slot communicating with and extending along the length of said receiving channel, said second slot being configured and dimensioned to accommodate longitudinal pinching and lateral insertion of said strap into said receiving channel, said flanges including:

undersides configured to accommodate receipt of said end tab in said receiving channel via said ently end, and to releasably wedge said end tab in and prevent withdrawal of said end tab from said receiving channel via said exit end;

converging sections leading from a maximum width of said slot at the entry end of said receiving channel to a reduced width of said slot at an intermediate location along the length of said channel;

jamming surfaces that slope inwardly into the receiving channel and extend from the entry end of the receiving channel toward stop surfaces to accommodate the lateral insertion and longitudinal pinching; and non-sloping surfaces that extend from said stop surfaces toward the exit end of the receiving channel to releasably wedge said end tab within the receiving channel.

2. The buckle of claim 1 wherein said base is formed as an integral part of a carrier structure.

3. For use with a flexible strap having a substantially uniform width and thickness and an end tab of increased thickness, a buckle for capturing and releasably retaining said end tab, said buclde comprising:

a base;

parallel side walls extending upwardly from and cooperating with said base to define an open-ended receiving channel having an entry end and an exit end; and flanges spaced vertically from said base and extending inwardly in cantilever fashion from said side walls to define an open-ended slot communicating with and extending along the length of said receiving channel, said slot being configured and dimensioned to accommodate longitudinal pinching and lateral insertion of said strap into said receiving channel, said flanges including;

undersides with downwardly sloping jamming surfaces configured to frictionally retain said end tab in said receiving channel;

converging sections leading from a maximum width of said slot at the entry end of said receiving channel to a reduced width of said slot at an intermediate location along the length of said channel;

jamming surfaces that slope inwardly into the receiving channel and extend from the entry end of the receiving channel toward stop surfaces to accommodate the lateral insertion and longitudinal pinching; and non-sloping surfaces that extend from said stop surfaces toward the exit end of the receiving channel to releasably wedge said end tab within the receiving channel.

4. The buckle of claims 1 or 3 wherein said end tab defines a shoulder extending transversally across the width of said strap, and wherein the stop surfaces are engageable with said shoulder.

5. The buckle of claim 3 wherein said base is secured to a section of said strap.

6. The buckle of claim 5 further comprising attachment slots extending transversally across said base, said buckle being attached to said strap by weaving said strap into and out of said channel through said attachment slots.

7. The buckle of claim 3 wherein said base is formed as an integral part of a carrier structure.

* * * * *

UNITED STATES PATENT AND TRADEMARK OFFICE

CERTIFICATE OF CORRECTION

PATENT NO. : 7,340,803 B2
APPLICATION NO. : 10/822549
DATED : March 11, 2008
INVENTOR(S) : Frank A. Howell It is certified that error appears in the above-identified patent and that said Letters Patent is hereby corrected as shown below:

In Claim 1, Col. 4, line 41, please delete “aftached” and replace with --attached--.

In Claim 1, Col. 4, line 53, please delete “ently” and replace with --entry--.

In Claim 3, Col. 5, line 6, please delete “buclde” and replace with --buckle--.

Signed and Sealed this

Third Day of June, 2008

JON W. DUDAS
*Director of the United States Patent and Trademark Office*